United States Patent [19]

Swihart

[11] Patent Number: 4,990,375

[45] Date of Patent: Feb. 5, 1991

[54] METHOD OF FORMING RECEPTOR SHEETS WITH AN IMAGE-BEARING NON-RECEPTOR SURFACE

[75] Inventor: Donald L. Swihart, Stillwater, Minn.

[73] Assignee: Minnesota Mining and Manufacturing Company, St. Paul, Minn.

[21] Appl. No.: 260,262

[22] Filed: Oct. 20, 1988

[51] Int. Cl.[5] ..... B29C 59/04; B05D 5/06

[52] U.S. Cl. ..... 427/278; 264/1.3; 264/134; 264/284

[58] Field of Search ..... 264/1.3, 284, 134; 427/274, 278

[56] References Cited

U.S. PATENT DOCUMENTS

| | | | |
|---|---|---|---|
| 3,196,062 | 7/1965 | Kristal | 264/284 |
| 3,374,303 | 3/1968 | Metz, Jr. | 264/284 |
| 3,619,454 | 11/1971 | Sakata et al. | 264/210 |
| 4,312,686 | 1/1982 | Smith et al. | 156/209 |
| 4,312,937 | 1/1982 | Kasper et al. | 430/496 |
| 4,447,524 | 5/1984 | Uno et al. | 430/538 |
| 4,481,289 | 11/1984 | Honma | 430/532 |
| 4,486,377 | 12/1984 | Lucchesi et al. | 264/284 |
| 4,556,527 | 12/1985 | Sarcander | 264/284 |
| 4,608,221 | 8/1986 | Kurtz et al. | 264/284 |
| 4,737,329 | 4/1988 | Rakoczy | 264/132 |

FOREIGN PATENT DOCUMENTS 260669 11/1926 United Kingdom ..... 264/1.3

OTHER PUBLICATIONS

V. M. Wolpert, *Synthetic Polymers and the Paper Industry,* Miller Freeman Publications, Inc., pp. 70–77, 202–219 and 224–231.

F. R. Gould, *Specialty Papers,* Noyes Data Corporation, 1976.

R. H. Mosher et al., *Industrial and Specialty Papers,* Chemical Publishing Company, Inc., 1970.

Ronald G. MacDonald et al., *Pulp and Paper Manufacture,* McGraw-Hill Book Company, 1976.

*The Dictionary of Paper,* 4th Ed., American Paper Institute, Inc., 1980, pp. 160–161.

*Primary Examiner*—James Lowe

*Attorney, Agent, or Firm*—Donald M. Sell; Walter N. Kirn; Mark A. Litman

[57] ABSTRACT

A receptor sheet for image-transfer processes is provided by providing a backside polymeric coating on the sheet with differential surface characteristics which can be visually observed. The characteristics may define a logo to differentiate the backside from the receptor surface.

6 Claims, 1 Drawing Sheet

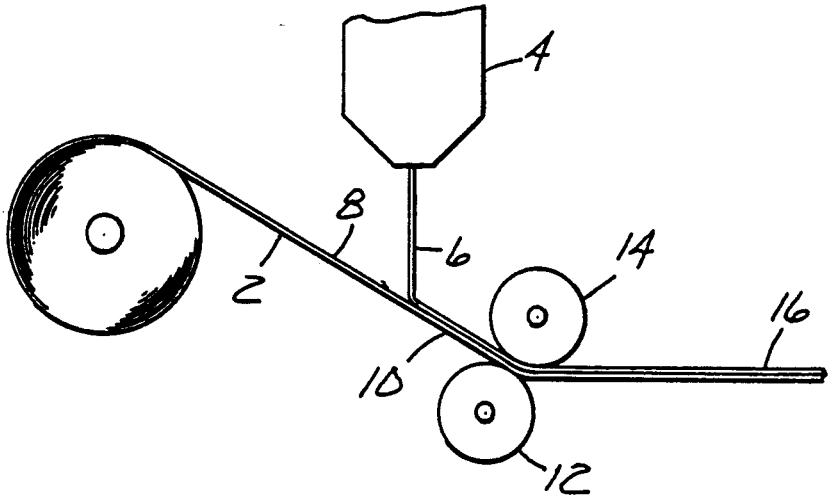
4
8
6
14
2
16
10
12

METHOD OF FORMING RECEPTOR SHEETS WITH AN IMAGE-BEARING NON-RECEPTOR SURFACE

BACKGROUND OF THE INVENTION

1. Field of the Invention

The present invention relates to receptor sheets for use in transfer or deposit imaging systems and particularly to receptor sheets having indicia on a nonimage receiving surface.

2. Background of the Art

Many imaging materials and processes require specialty papers in order to perform at their highest levels. Photographic paper often comprises a white paper base with a coating of resin or pigmented resin. Usually the pigment is white (e.g., $TiO_2$) in order to provide a bright white background (U.S. Pat. No. 4,481,289, 4,447,524, and 4,312,937). Transfer or deposit imaging systems such as thermal transfer (e.g., U.S. Pat. No. 4,690,858 and 4,614,682), photoresist transfer (e.g., U.S. Pat. No. 4,710,445, 4,656,114, and 4,666,817), ink jet printing, and the like perform best when a surface has been particularly designed to function in combination with the imaging material being deposited. Sometimes the design is enhanced to contribute to either the optical qualities of the material or to its physical adherence properties.

For example, U.S. Pat. No. 4,614,682 describes a paper receiving sheet for thermal image transferring processes as plain paper, or paper with a coating of resin and filler (e.g., pigments such as titanium oxide, or zinc oxide) for facilitating the transfer of a dye component from the donor layer to the transfer sheet. U.S. Pat. No. 4,690,858 describes the use of coated paper as a receptor sheet (col. 4, lines 31–34).

These receptor sheets do not necessarily have the same type of surfaces on both sides of the base layer. This can be done to save costs during manufacture or to prevent images from being deposited on both sides of the receptor With many types of differences between the surfaces of the receptor sheet, it is still somewhat difficult to distinguish the receptor surface from the backside. This can create an appearance of poor performance in the product if the wrong surface is used. To assist in the proper recognition of the receptor surface, the backside of the receptor sheet is sometimes printed with ink as with a logo of the manufacturer, to distinguish the front side from the back. Dark inks can often be seen through the sheet, and even the low optical density printing used can be observed with transmitted lighting. The printing step may also require a separate processing line, which adds to the expense, and certain preferred coatings (e.g., olefins and polyester) do not accept print easily.

Polyolefin film filled with titania and having a backside adhesive coating are used as diaper tabs. The film is sometimes marked by embossing after extrusion. The embossing creates significant variations in the transmission optical density as well as the reflection optical density of the film. The embossing affects both surfaces of the film, but is partially masked on one side by the adhesive.

SUMMARY OF THE INVENTION

Chill roll marking of the backside of polymer coated paper receptor sheets after extrusion of the polymer coating onto the paper and before cooling of the coating produces a differentially reflected image which is clearly discernible visually and distinguishes the backside of the receptor sheet from the front side.

BRIEF DESCRIPTION OF THE DRAWING

The FIGURE shows the actual performance of the process of the present invention.

DETAILED DESCRIPTION OF THE DRAWING

The figure shows the operation of the process of the present invention. A sheet of paper (2) passes under an extrusion device (4) where a thermoplastic polymer coating composition stream (6) is deposited upon one surface (8) of the paper (2). The coated paper (10) then passes between two nip rollers (12,14). The nip roller (16) in contact with the polymer coated surface of the paper (10) is at a temperature below that of temperature of the polymer (6) on the paper (2). After passing through the nip rollers (12,14), the surface (16) of the polymer coated paper bears an image (not shown) produced by the surface characteristics of nip rollers (14).

DETAILED DESCRIPTION OF THE INVENTION

Coated papers for use as photographic bases on receptor sheets for images can be produced normally in a multistage process which involves 1) providing a paper base, (2) optionally priming the paper base, (3) extruding a polymer coating composition onto said paper base, (4) passing the coated paper between nip rollers, the coated surface of the paper contacting the surface of a chill roll as part of the nip rollers, (5) moving said coated sheets in contact with said chill roll to cool said extruded polymer, (6) removing said coated paper from the chill roll and (7) winding up said coated paper. The practice of the present invention does not require a major change in the apparatus used in the general paper coating process. By providing a chill roll having a surface with differential surface characteristics, a readily readible image can be produced on the coated paper. By the term "differential surface characteristics" is meant that between predetermined areas in the chill roll surface there is a difference in the physical properties or dimensions (i.e., height above a reference axial level) so that visually observable different characteristics can be imposed on a softened polymeric surface. This term does not require the presence of a relief image (either positive or negative) on the surface of the chill roll. In fact, relief images are not preferred. It is desirable to have the surface of the chill roll provided with areas of different smoothness so that a difference in reflectivity is imposed upon the coated paper. This offers a number of significant benefits. If there is no relief embossing composed upon the coated paper, there is no significant differential in paper and there is no significant differential in transmissivity created in the coated paper because of variations in the thickness of the polymer coating. It is desirable to keep the surface variations on the chill roll and the resultant impressions on the polymer coating surface to less than 30 microns, preferably less than 20 microns, more preferably less than 15 microns and even less than 8 microns. With these small variations in thickness, very little or no variations can be seen in the optical density of the paper, even in a transmission mode. There need be no variation in thickness at all, as a difference in the smoothness (roughness) of the surface creates a visually observable characteristic.

The paper base itself may comprise either natural fiber, synthetic fiber, or a mixture of both materials. The paper usually weighs between 20 and 200 g/m$^2$ without the coating thereon. Each polymer coating on the paper usually weighs between 5 and 150 g/m$^2$, depending upon the particular purpose of the sheet. This weight is inclusive of any whitening pigment which is usually present as from 1 to 50% by weight of the coating. Titanium oxide is the most preferred pigment but other inorganic oxides and even carbonates can be used.

It is desirable that the paper not exhibit a variation in optical density between the marked or unmarked areas on the backside when there is backlighting on the paper base. There should be an optical density variation of less than 0.2 when viewed in the transmission mode with high intensity room lighting. Preferably there should be an optical density variation of less than 0.1 when so viewed.

The temperature of the resin during extrusion is usually between 90 and 200° C., the temperature of the chill roll is usually between 0 and 40° C. The speed of the paper through the operation is usually between 100 and 500 ft/min (30 to 150 m/min).

The polymer used in the coating operation may be substantially any transparent (preferably colorless) thermoplastic resin such as polyolefins, nylons, polyesters, polyvinyl resin and the like. Polyolefins such as polyethylene, polypropylene, and mixtures, blends, and copolymers thereof are most preferred.

These and other aspects of the invention will be understood from a reading of the following non-limiting Example.

EXAMPLE

A roll of commercially available white, primed paper stock is fed by rollers towards an extrusion head at about 91 meters per minute. A composition comprising 85 percent by weight polyethylene and 15 percent by weight titania is extruded at 120° C. onto the paper at a coating weight of about 30 g/m$^2$. The coated paper passes into a nip roll. The roll contacting the coated face of the paper is maintained at an average temperature of about 10° C. The paper is wound after leaving the surface of the chill roll.

The surface of the chill roll had areas that were roughened to outline a repeat image that showed "SCOTCH". The image area was smooth. Unwinding a portion of the rolled paper and viewing the sheet in a reflective mode, the more reflective areas of the sheet outlined the figure "SCOTCH". Looking at the paper with material sunlight from a northern exposure, no variation in optical density through the sheet could be observed.

I claim:

1. A process for the manufacture of a paper base for imaging materials comprising the steps of (a) providing a paper base, (b) extrusion coating a thermoplastic polymer onto one surface of said base, (c) passing said paper base between a set of nip rollers, (d) cooling said thermoplastic polymer by having one of said nip roller at a temperature below the temperatures of said polymer, said one of said nip rollers contacting said polymer, and (e) removing said base from said one of said nip rollers, the surface of said one of said nip rollers having differential surface characteristics with vertical variations of less than 20 microns so that cooling of said polymer by said one of said nip rollers generates a visually observable image.

2. The process of claim 1 wherein the differential surface characteristics on said roller display vertical variations of less than 15 microns so that a substantially non-relief image is formed.

3. The process of claim 2 wherein said image formation does not cause a significant variation in transmissivity caused by variations in the thickness of said polymer.

4. The process of claim 1 wherein said differential surface characteristics consist essentially of a difference in smoothness of the surface of said one nip roller, and said image is a non-relief image.

5. The process of claim 4 wherein said image formation does not cause a significant variation in transmissivity caused by variations in the thickness of said polymer.

6. The process of claim 1 wherein said image formation does not cause a significant variation in transmissivity caused by variations in the thickness of said polymer.

* * * * *

UNITED STATES PATENT AND TRADEMARK OFFICE

CERTIFICATE OF CORRECTION

PATENT NO. : 4,990,375

DATED : February 5, 1991

INVENTOR(S) : Swihart

It is certified that error appears in the above-identified patent and that said Letters Patent is hereby corrected as shown below:

Col. 2, line 55 and 56, After "there is no" delete --significant differential in-- and insert --physical damage done to the--

Signed and Sealed this

Twenty-sixth Day of October, 1993

*Attest:*

*Attesting Officer*

Bruce Lehman

BRUCE LEHMAN

*Commissioner of Patents and Trademarks*